US006827348B1

(12) United States Patent
Mitchell

(10) Patent No.: US 6,827,348 B1
(45) Date of Patent: Dec. 7, 2004

(54) METHOD OF PLAYING A WAGERING GAME

(76) Inventor: Tyrone Emmitt Mitchell, 2038 Palm St., Ste. 161, Las Vegas, NV (US) 89104

( * ) Notice: Subject to any disclaimer, the term of this patent is extended or adjusted under 35 U.S.C. 154(b) by 0 days.

(21) Appl. No.: 10/783,544

(22) Filed: Feb. 20, 2004

(51) Int. Cl.[7] ..... A63F 1/00
(52) U.S. Cl. ..... 273/292; 273/309
(58) Field of Search ..... 273/292, 309, 273/274; 463/12, 13

(56) References Cited

U.S. PATENT DOCUMENTS

| | | | | |
|---|---|---|---|---|
| 5,288,081 | A | | 2/1994 | Breeding |
| 5,711,525 | A | | 1/1998 | Breeding |
| 5,718,430 | A | | 2/1998 | Aramapakul |
| 5,794,934 | A | | 8/1998 | Malcolm |
| 5,816,914 | A | | 10/1998 | Wichinsky |
| 5,845,906 | A | | 12/1998 | Wirth |
| 5,845,907 | A | | 12/1998 | Wells |
| 5,964,464 | A | | 10/1999 | Jones |
| 5,984,310 | A | | 11/1999 | English |
| 6,102,402 | A | * | 8/2000 | Scott et al. ..... 273/292 |
| 6,517,072 | B1 | | 2/2003 | McInerney |
| 6,581,936 | B1 | * | 6/2003 | Zoccolillo et al. ..... 273/274 |
| 6,651,983 | B1 | | 11/2003 | Chobanian |
| 6,698,757 | B1 | | 3/2004 | Timpano |

* cited by examiner

*Primary Examiner*—Benjamin Layno

(57) ABSTRACT

A playing card wagering game method that involves each player wagering an initial blind bet against the dealer and an optional premium odds side bet for premium dealt hands having a rank equal to a pair of aces or higher rank within the first five cards players are dealt, resulting in a payout of six to one. Each player and the dealer are dealt five cards in succession face down. Two common cards are dealt face down in succession. Dealer turns dealer's dealt hand face up to reveal rank of cards. Players elect to hold on their dealt hands for higher odds payout of two to one or place a draw bet equal to their initial bet to include the use of the two common cards in play to improve their hands, resulting in payouts of even odds for using the first common card and one half odds, one for two, for using the second common card. Dealer turns first and second common cards face up. Dealer always uses dealer's dealt hand and both common cards to make highest ranked poker hand possible. Dealer turns players' cards face up declares rank of all hands, and resolves all wagers.

1 Claim, 1 Drawing Sheet

Apparatus 11 - Top View

METHOD OF PLAYING A WAGERING GAME

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

The present invention relates to playing a wagering card game that can be played with a standard deck of cards and a game board in a casino or home environment or by video technology in both a casino and home environment.

2. Background of the Invention

There are hundreds of patented wagering card games offering a wide variety of options and decision making choices to a player. However, there are only a few of these games that fall within the narrow band of profit set by state gaming boards. These patented card games also fail to give the casino a proper profit margin if they are adjusted in play to meet state gaming regulations. Most of these games are frivolous in design for casinos.

The present invention meets all state regulations because it is based upon a mathematical relationship discovered by the inventor when researching the standard game of poker. The win ratio to total bets falls within the legal limits giving the casinos a comfortable fifteen percent profit.

Wagering games for casino play with multiple wagering opportunities are known. U.S. Pat. No. 5,845,906 (to Wirth) discloses methods of drawing additional cards individually to improve a five card hand dealt to the players. The prior patent discloses the use of a common pot among the players that the casino does not participate in, violating state regulatory agencies laws. A wagering game's legal status is based upon total wagers made by the players compared to the win factor of the game for casino.

A wagering game, U.S. Pat. No. 5,718,430 (to Aranaspakul, et al.) discloses methods of using eight cards to make a five card poker hand for the players. This method of play does not fall within the standard rules of poker widely accepted by the general public as it uses eight cards instead of seven cards. The game is a variation of the commonly known game of Texas Hold'em.

The most interesting wagering game, U.S. Pat. No. 5,984,310 (to English) is a version of five card draw where a player is awarded higher odds on a standard ranked hand obtained by the player in their initial hand dealt. The odds are not directly based upon the number of cards used by the player to make a standard ranked hand, but on the ranked hand obtained. The player is allowed to draw additional cards whereupon the player loses the higher odds and even odds prevail. This method of play requires the players to draw individual cards which is time consuming to a casino. The game does not use common cards in play. The game also involves the use of more than seven cards as a player is allowed to draw an equal number of discarded cards, the number of cards discarded is not designated.

A method of playing a wagering card game, where less than five cards are dealt to a player, U.S. Pat. No. 5,288,081 (to Breeding), involves the use of two common cards, however the game is a version of five card stud where players place a three part wager and are allowed to withdrawal part of their wager after being dealt three cards. The common cards are turned up one at a time to improve the player's hands. Players must obtain a hand with a pair of tens or higher to win wagers. Though one of the most popular table games in play today, payout odds are based upon the rank of hand obtained by the player and not based upon the number of cards used by the player. Most payouts on ranked hands in the game would take a life time of play to obtain in five card stud. Since players receive partial hands, the game quickly becomes boring and frustrating for the players.

OBJECTS AND ADVANTAGES

In accordance with the present invention, there are several objects and advantages:

(a) cards are dealt in succession reducing the time involved in dealing the cards;

(b) two common cards are used instead of dealing individual draw cards to players, reducing the number of cards in play;

(c) no antes are required that reduce a player's win factor when poor hands are dealt;

(d) there are no qualifying of the dealer's hands that restricts a player with a high ranking hand from receiving a proper return on their wager;

(e) all poker hands dealt remain live and in action at the highest payout odds the present invention has to offer, unless players choose to draw to improve their hands;

(f) a premium high odds side bet for low ranked hands is included in the present invention allowing players a chance to recover their loss wagers;

(g) players are allowed to improve dealt hands by placing a draw bet equal to their initial bet.

In accordance with the most important feature of the present invention, players place an initial bet and once all cards are dealt, the dealer reveals the dealer's dealt hand for all players to evaluate prior to any player taking a choice of action to draw or hold in the game. No prior art has this feature incorporated in its structure or design. This feature allows players to take an educated choice of action.

In accordance with the present invention, there is a game board with six playing areas to accommodate players a top a flat semi-circular table with a dealer's playing area, common cards area, and a premium odds bet line.

In accordance with the present invention to be trade marked as "Nevada Hold'em", said game is a variation of a combination of five card stud, draw poker, and seven card stud with two common cards in play that will attract hold'em poker players, who do not normally play table games, due to its higher odds payout of two to one on a single wager.

SUMMARY

It is a general object of the present invention to provide a rapid and high odds casino type wagering card game where reasonably low ranked hands are accompanied with reasonable payout odds over short term play with every hand dealt having the capacity to win.

The method of playing a casino type wagering card game of the present invention includes the initial step of each player placing an initial blind bet to participate in the game.

Each player has the option to place a premium odds bet not to exceed said player's initial bet for any premium hand dealt to said player within the first five cards dealt to said player.

Five cards in succession are dealt face down to each player and the dealer. Two common cards are dealt in succession face down between the dealer and the players, with the first common card being referred to as the "even" card and the second common card being referred to as the "half" card. Each player inspects and evaluates their dealt hand. The dealer turns the dealer's dealt hand face up revealing the rank of the cards to all players.

Each player takes action by placing their hand face down on the playing table to hold on five cards or take action by placing a second bet called a draw bet that must be equal to said player's initial bet to use the two common cards in play to improve their hand.

Players holding on their initial dealt hand of five cards are entitled to two parts for every one part wagered by said player should the rank of said player's hand be higher than the dealer's hand using five cards selected from seven cards available to the dealer, said seven cards comprised from the dealer's dealt hand containing five cards and the two common cards in play.

Players electing to use the two common cards in play and having placed a draw bet are entitled to reduced odds on their total wagers comprised of both their initial bet and draw bet. Should the first common card be included and play within the drawing player's ranked hand and said ranked hand be a higher ranked hand than the dealer's ranked hand, player is entitled to an "even" payout of one part for every one part wagered by said player. Should the second common card be included and play within the drawing player's ranked hand and said ranked hand be a higher ranked hand than the dealer's ranked hand, player is entitled to a "half" payout of one part for every two parts wagered by said player. Should neither the first and second common card be included within the drawing player's ranked hand and said ranked hand be a higher ranked hand than the dealer's ranked hand, player is entitled to an "even" payout of one part for every one part wagered by said player.

After all players take action and place their hands face down on the playing table, the dealer turns the first and second common cards face up to reveal each card's rank. Dealer declares dealer's highest ranked five card poker hand using only five cards to make said poker hand from the dealer's dealt hand of five cards and the two common cards in play.

Dealer turns each player's dealt hand face up. Players having placed a premium odd bet and having a premium hand equal to the rank of a pair of aces or higher ranked hand within said player's first five cards, receive from the dealer a payout of six parts for every one part bet by said player on the premium bet line and said player retains the premium bet on the premium odds bet line. Players having placed a premium odds bet and does not have a premium hand forfeits said premium odds bet to the dealer. Players with an equal ranked hand to the dealer's ranked hand, have a "pushed hand", resulting in the player neither winning or losing said player's initial bet and any draw bet. Players with a lower ranked hand than the dealer's ranked hand forfeit said player's initial bet and any draw bet. Dealer resolves all bets made by players with higher ranked hands than the dealer's ranked hand.

BRIEF DESCRIPTION OF THE DRAWING

The FIG. 1 shows a game layout which may be utilized to play the game of the present invention.

DETAILED DESCRIPTION OF THE PREFERRED EMBODIMENT

Figure 1:
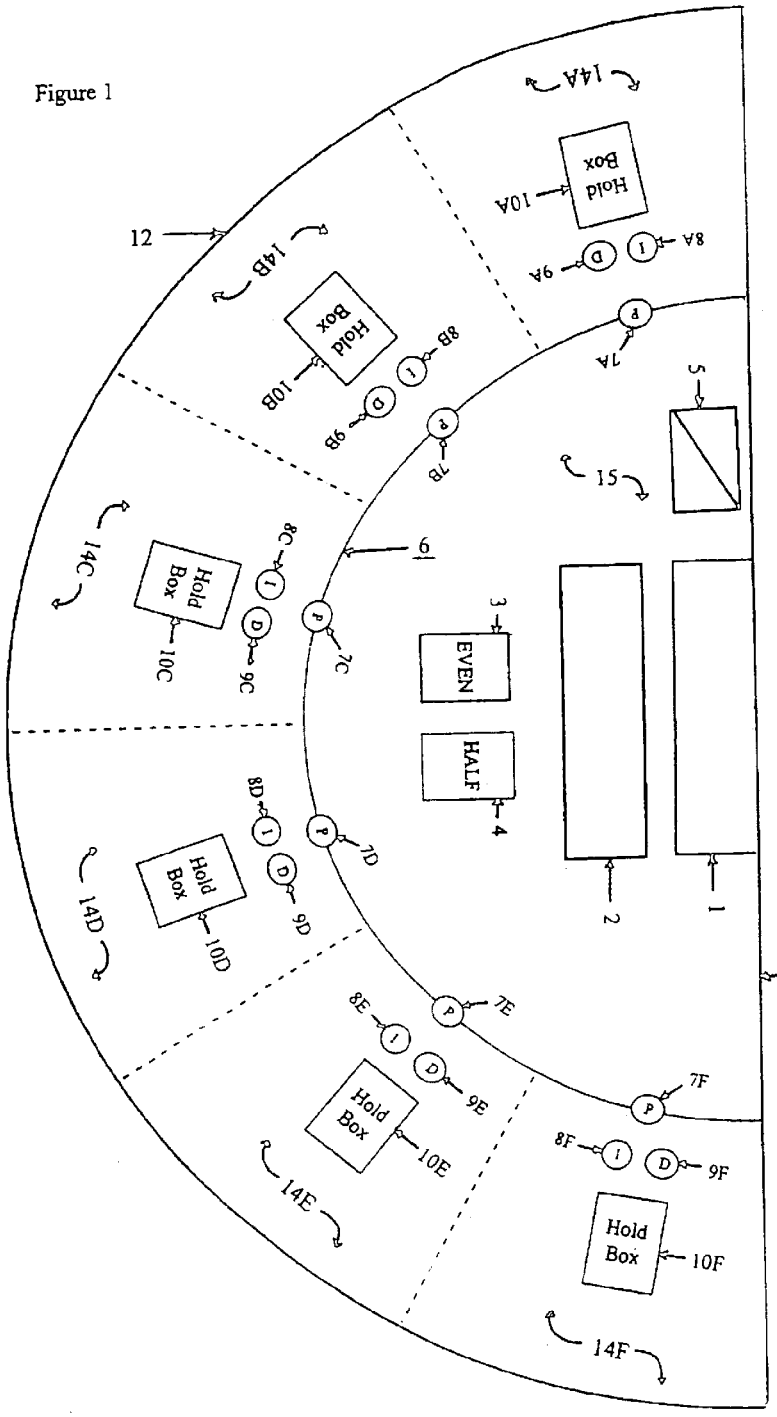

Referring now to the drawing of FIG. 1, the apparatus 11 for the wagering game of the present invention sets a top a typical semi-circular casino gaming table not shown in FIG. 1. The apparatus 11 can be made with felt or other appropriate material. Apparatus 11 has a curved side 12 for accommodating up to six players and a straight side 13 for accommodating the dealer. There are six individual player's areas 14A–F and one dealer's area 15.

Within each player's area 14A–F, there is one rectangular outlined hold box 10A–F, slightly larger in size than the playing cards used in the present invention. Within each hold box 10A–F, are two words, first word "Hold" above the second word "Box". Within each player's area 14A–F, there is one outlined initial bet circle 8A–F and one outlined draw bet circle 9A–F. Within each circle 8A–F is capital letter "I" and within each circle 9A–F is a capital letter "D". Circles 8A–F and circles 9A–F are slightly larger than the wagering clips used in the present invention.

There is a semi-circular premium odds bet line 6 with six premium bet circles 7A–F interrupting said line 6, said line 6 dividing said player's area 14A–F from said dealer's area 15.

Each circle 7A–F interrupts line 6, center to each corresponding area 14A–F. Each circles 7A–F is slightly larger than the wagering chips used in the present invention. Each circle 7A–F has a capital letter "P" within said circle.

There is one said dealer's area 15. Within area 15 is one chip box 1 to accommodate sufficient dealer's chips, one rectangular outlined dealer's box 2, slightly larger than five cards spread out without over lapping or touching each other, one rectangular outlined even box 3, said box 3 slightly larger than cards used, within said box 3 is one word "EVEN", one rectangular outlined half box 4, said box 4 slightly larger than cards, within said box 4 is one word "HALF", and one burnt card tray 5, said tray 5 larger enough to accommodate a deck of fifty-two cards.

OPERATION OF PREFERRED EMBODIMENT

The dealer is to shuffle and cut the playing cards within the dealer's area 15. For simplicity of description, players A–F use corresponding player's area 14A–F and all corresponding box 10A–F, circle 7A–F, circle 8A–F, and circle 9A–F. Each player A–F is to place initial bet in corresponding circle 8A–F. Each player A–F have the option to place a premium odds bet within corresponding cirle 7A–F. Dealer is to deal each player A–F five cards in succession face down and place cards face down in box 10A–F. Dealer is to deal a dealer's hand comprised of five cards in succession face down and place said hand face down in box 2. Dealer is to deal two common cards face down and place one common card face down in box 3 and one common card face down in box 4. Dealer is to place remainder of playing cards in box 5.

Players A–F pick up their dealt hand in corresponding box 10A–F, inspects and evaluate said hands. Dealer turns dealer's dealt hand face up and spreads cards out to reveal the rank of the cards within said box 2.

Each player A–F elects to take action by placing dealt hands face down in corresponding box 10A–F or take action by placing a draw bet in circle 9A–F and then place their cards face down in corresponding box 10A–F.

Dealer is to turn common cards in box 3 and box 4 face up to reveal rank of both cards. Dealer is to evaluate all hands in box 10A–F by turning said cards face up and spreading cards within area 14A–F.

Dealer is to resolve all bets in circle 7A–F, circle 8A–F, and circle 9A–F. Dealer is to remove all cards in box 10A–F, box 2, box 3, and box 4, and place cards face down in tray 5.

ADVANTAGES OF EMBODIMENT

From FIG. 1, one can clearly see the advantages of the embodiment in the placement of bets and cards within the reach of the dealer. Having separate circles for separate bets aids the dealer in identifying players who have placed premium bets, initial bets, and draw bets. Having hold boxes helps the dealer to spot helded hands by players and reduces the chance of players slipping in additional cards or swapping cards. Common cards boxes keep common cards separate and identify which common card offers which odds payout.

CONCLUSION, RAMIFICATIONS, AND SCOPE

Since the present invention is based upon a sound mathematical relationship derived from the standard rules of poker, there are few variations of the present invention that can be included within the scope of the present invention without affecting its ability to qualify as a legal wagering game for casinos by state regulatory agencies.

The psychological effects of the dealer revealing the rank of the dealer's dealt hand prior to any action taken by the players is astonishing and unpredicted. It adds a whole new dimension to casino wagering games.

I claim:

1. A method of playing a wagering card game with a plurality of players using a standard deck of fifty-two playing cards, having a standard rank, said game involving standard poker hand ranking, including a premium odds of six to one ratio offered on one side bet for all said standard poker hand ranks equal to a pair of aces or higher ranked poker hands, and is comprised of the following steps, (A) Each player places an initial bet to participate in the game, (B) Each player has the option to place one premium odds side bet not to exceed said initial bet, (C) Each player is dealt five cards in succession face down, (D) Dealer is dealt a dealer's hand comprised of five cards in succession face down, (E) Two common cards are dealt in succession face down, said cards being common to said players and said dealer, (F) Each player inspects and evaluates said dealt hands, (G) Dealer turns said dealer's dealt hand face up to reveal rank of said cards to all players, (H) Players take action by placing said players' dealt hands face down to hold on five cards, (I) Players take action by placing a draw bet equal to said initial bet to be entitled to include said two common cards in said players' dealt hands and said players place said dealt hands face down, (J) Dealer turns first common card face up to reveal the rank of said card, (K) Dealer turns second common card face up to reveal the rank of said card, (L) Dealer declares dealer's highest ranked five card poker hand using only five cards from said dealer's dealt hand and said two common cards in play, (M) Dealer turns each said player's dealt hand face up and declares said player's highest ranked five card poker hand using only the number of cards said player is entitled to include in said player's poker hand, (N) Player having a said ranked poker hand equal to a pair of aces or higher ranked hand within the first five cards of player's dealt hand, have a said premium ranked hand, (O) Player having said premium ranked hand, having placed said premium odds side bet is entitled to a bet resolving payout of six parts for every one part wagered by said player on said premium odds side bet from said dealer, and said player retains said premium odds side bet, (P) Player having held on said player's dealt hand of five cards and having a higher ranked poker hand than said dealer's ranked poker hand is entitled to a bet resolving payout of two parts for every one part wagered by said player on said player's initial bet from said dealer, (Q) Player having placed said draw bet and having a higher ranked poker hand than said dealer's ranked poker hand, and does not include the use of said second common card with said player's ranked poker hand to have said poker hand rank, is entitled to a bet resolving payout of one part for every one part wagered by said player on said player's initial bet and draw bet from the dealer, (R) Player having placed said draw bet, having a higher ranked poker hand than said dealer's ranked poker hand, and having to use said second common card within said player's ranked poker hand to have said poker hand rank, is entitled to a bet resolving payout of one part for every two parts wagered by said player on said player's initial bet and draw bet from said dealer, (S) Player having placed said draw bet, having a higher ranked poker hand than said dealer's ranked poker hand, and having to use neither said first common card and said second common card within said player's ranked poker hand to have said poker hand rank, is entitled to a bet resolving payout of one part for every one part wagered by said player on said player's initial bet and draw bet from said dealer, (T) Player having a ranked poker hand equal to said dealer's ranked poker hand, have a "pushed hand", resulting in said player neither winning or losing said player's initial bet and any draw bet, (U) Player having a lower ranked poker hand than said dealer's ranked poker hand forfeit said player's initial bet and any draw bet to said dealer, (V) Player having placed said premium odds side bet and having no said premium hand within said player's dealt hand of five cards, forfeit said player's premium odds side bet to said dealer, (W) Dealer is to resolved all bets with said players and collect and retain all forfeited bets by said players.

* * * * *